US007191909B2

(12) United States Patent
Heinisch et al.

(10) Patent No.: US 7,191,909 B2
(45) Date of Patent: Mar. 20, 2007

(54) COVER FOR COUPLING HEAD

(75) Inventors: Andreas Heinisch, Rethen (DE); Christian Radewagen, Salzgitter (DE)

(73) Assignee: Voith Turbo Scharfenberg GmbH & Co. KG, Salzgitter-Watenstedt (DE)

( * ) Notice: Subject to any disclaimer, the term of this patent is extended or adjusted under 35 U.S.C. 154(b) by 0 days.

(21) Appl. No.: 10/490,351

(22) PCT Filed: Jan. 24, 2003

(86) PCT No.: PCT/EP03/00745

§ 371 (c)(1),
(2), (4) Date: Mar. 22, 2004

(87) PCT Pub. No.: WO03/084795

PCT Pub. Date: Oct. 16, 2003

(65) Prior Publication Data

US 2004/0238474 A1 Dec. 2, 2004

(30) Foreign Application Priority Data

Apr. 4, 2002 (EP) ..... 02007697

(51) Int. Cl.
*B61G 1/00* (2006.01)

(52) U.S. Cl. ..... 213/75 R

(58) Field of Classification Search ..... 213/75 R, 213/97, 103, 104; 105/280, 285
See application file for complete search history.

(56) References Cited

FOREIGN PATENT DOCUMENTS

| | | | |
|---|---|---|---|
| DE | 43 00 393 | A1 | 1/1993 |
| DE | 199 26 058 | A1 | 6/1999 |
| EP | 0 811 539 | A2 | 11/1996 |
| EP | 0811539 | A2 * | 11/1996 |
| EP | 0 870 667 | A2 | 1/1998 |
| JP | 2000-344101 | | 4/1999 |

OTHER PUBLICATIONS

International Preliminary Examination Report for PCT/EP03/00745 mailed on Nov. 14, 2003.

International Search Report for PCT/EP03/00745 mailed on May 9, 2003.

* cited by examiner

*Primary Examiner*—S. Joseph Morano
*Assistant Examiner*—Robert J. McCarry, Jr.
(74) *Attorney, Agent, or Firm*—Brooks Kushman P.C.

(57) ABSTRACT

The invention relates to a cover for a coupling head to protect a coupling head (12), particularly the moving components found therein, against environmental influences such as dirt, snow, icing and mechanical shocks. The functioning of the coupling head cover is such that an automatic coupling process between two vehicles is further guaranteed. A shroud (6) is provided, which may be pivoted from a working or uncoupled position, in which the shroud (6) is arranged in an essentially vertical position in front of the coupling head (6), into a rest or coupled position above the coupling (11). A jointed arrangement (7,B,C,D) is provided for pivoting the shroud (6), connected to both the shroud (6) and the coupling (11) or a frame (9) arranged on the coupling (11).

12 Claims, 2 Drawing Sheets

COVER FOR COUPLING HEAD

BACKGROUND OF THE INVENTION

1. Field of the Invention

The invention relates to a cover for a coupling head, in particular for a coupling head of an automatic central coupling or central buffer coupling for a freight car given a multiple-unit rail vehicle, as well as to a method for pivoting the coupling head cover.

2. Background Art

A device for protecting assemblies or components in coupling arrangements is basically known from rail vehicle technology. For example, German Patent Specification DE 43 12 405 A1 describes a central buffer coupling for rail vehicles with a protective device, wherein the protective device also ensures protection in the area of the draw and buffering gear without any additional retrofitting, even in couplable or coupled rail vehicles. In this case, the coupling head of the respective central buffer coupling is equipped on both sides with protective straps, which are hinged to the frame of the rail vehicle. Hinging the protective straps to the central buffer coupling allows them to mimic the longitudinal movements of the coupling head that arise under a pressure or tensile load, protecting the coupling arrangement against mechanical impact. However, the protective device disclosed herein does not make it possible to also protect the assemblies or components of the coupling arrangement against environmental influences, such as dirt, ice or icing.

Also known from DE 199 26 058 A1 is an electrocontact coupling for automatic central or central buffer couplings in rail vehicles in which a protective cover horizontally pivoted to the contact carrier of the coupling head can be actuated via a lever mechanism, wherein the protective cover pivots in front of the contact carrier in the retracted position of a guiding sled, and downwardly in the advanced, couple-ready position. The protective cover is here pivoted continuously with the longitudinal movement of the guiding sled. To this end, the lever mechanism can be tensioned with a spring. This protective device known from prior art is here designed in such a way as to only protect the contact carrier, i.e., the mounting unit for electrical terminals. Other components of the coupling arrangement, e.g., the centering elements, air duct couplings or claw arrangement, are not covered by the protective device, and are hence freely exposed to mechanical and environmental influences. The known protective device consists of a protective cover with guiding sled, lever mechanism and various other components, wherein these assemblies are additionally permanently integrated in the coupling arrangement, providing no assurance that this protective device can be replaced or subsequently installed through simple assembly on the coupling.

The disadvantage to known protective devices of the kind mentioned at the outset is that they do not afford sufficient protection to the components or assemblies of the entire coupling arrangement against mechanical loads or environmental influences. In addition, efforts to indicate or arrange a cover or similar device in the coupling arrangement in such a way that it can be quickly replaced or subsequently installed without any special outlay through simple assembly on the coupling have thus far met with failure in known protective devices. The protective devices known from prior art are components permanently integrated into the coupling arrangement, which can only be removed or added by replacing the entire coupling arrangement.

SUMMARY OF THE INVENTION

Proceeding from the problem as defined, the object of the invention is to indicate a device for protecting a coupling head, in particular the moving assemblies located therein, against environmental influences, such as dirt, snow, and ice, and also against mechanical loads, while also ensuring an automatic coupling process between two coupling arrangements. Another object of the invention is to indicate the easiest possible method for pivoting the protective device in such a way as to further ensure an automatic coupling process between two vehicles.

The technical problem underlying this invention is resolved by a cover for a coupling head, in particular for a coupling head of an automatic central coupling or central buffer coupling on a freight car given a multiple-unit rail vehicle, in which the cover is characterized by a shroud for protecting the coupling head, wherein the shroud can be pivoted out of a working or decoupling state, in which the shroud is arranged essentially perpendicular in front of the coupling head, and into a resting or coupling state above the coupling.

The procedural objective underlying this invention is further resolved according to the invention by the following steps: When pivoting the shroud out of the working or decoupling state into the resting or coupling state, the frame is also pivoted by a few degrees, and pivoted back again after the coupling process, whereupon the seal at the front edge of the frame then abuts the seal of the coupled freight car.

The advantages to the device according to the invention are in particular that the shroud, which can be pivoted from a working or decoupling state, in which it is arranged essentially perpendicularly in front of the coupling head, and into a resting or coupling state above the coupling, makes it possible to achieve a highly effective and especially easily realizable device for protecting the coupling head, in particular the moving assemblies and electrical contact arrangements situated therein, against environmental influences, such as dirt, snow, icing and moisture, and also against mechanical influences, such as unforeseen impacts. In this case, it is provided that this shroud can be pivoted into a resting or coupling state above the coupling, thereby further ensuring an automatic coupling process between two vehicles with integrated coupling head cover. Placing the shroud in front of the coupling head according to the invention ensures that the cover envelops the entire coupling head with all integrated assemblies or components in the protective area. This not only ensures that any air duct couplings and/or electrocontact couplings present in the coupling arrangement are nearly maintenance-free and always ready for use under any weathering conditions, but also that the moving assemblies located in the coupling arrangement are permanently protected in particular against coarse dirt and icing, also making them nearly maintenance-free and always ready for use. This makes it possible to use such coupling arrangements much more efficiently and cost-effectively than conventional coupling arrangements, which must be periodically maintained and cleaned. Protecting the coupling arrangement against icing in winter further eliminates the process of deicing the coupling arrangements, which involves significant technical or economic outlays and difficulties to accomplish.

The method according to the invention provides an opportunity to make the coupling head cover according to the invention especially easy to realize, and also to very effectively integrate it into the automatic coupling process in the case of coupling arrangements. It is here particularly advantageous that the pivoting motions during the coupling process cause one seal on the front edge of the frame to abut the seal of the coupled freight car, so that a coupling arrangement is also protected against moisture and similar environmental influences in the completely coupled state.

In one advantageous further development of the device according to the invention, a hinge arrangement is provided for pivoting the shroud, which is connected to the shroud on the one hand, and to the coupling or frame arranged on the coupling on the other. Because the assemblies belonging to the coupling head cover are secured exclusively to the coupling, no other mounts or attachment points are provided on the vehicle body or chassis, which in a particularly advantageous way makes it possible to easily assemble the coupling head cover to the coupling. The selected self-contained construction of the coupling head cover also yields the simple design of the coupling head cover. This makes it possible to very rapidly and easily replace the entire assembly if the coupling head cover is damaged. As a result, a coupling arrangement can be easily retrofitted with a coupling head cover according to the invention, without any particularly technical and financial outlays. The self-contained construction also enables extensive pre-assembly of the assembly in the manufacturing process. This enables efficient, and hence cost-effective, production and conversion of the coupling head cover according to the invention. The shroud is provided with bracket-like arrangements in a particularly advantageous fashion, which are used as units for securing or contacting components provided to pivot the shroud. Of course, other solutions are also conceivable here.

In a particularly advantageous embodiment, the hinge arrangement in the coupling head cover has a triple-hinge with three fulcrums and one hinged arm. As a result, the number of moving parts can be reduced to a minimum in the coupling head cover according to the invention, minimizing wear to the coupling head cover and its hinge arrangement, and hence ensuring a nearly unlimited applicability of the coupling head cover according to the invention. A triple-hinge with three fulcrums and a hinged arm also exhibits only a largely linear mobility, so that the shroud moves linearly when pivoted, in particular in the coupling direction, largely preventing the latter from horizontally pivoting. Of course, other embodiments of the hinge arrangement are also conceivable here.

In one possible realization of the coupling head cover according to the invention, the hinged arm is hinged at one end to the coupling or to the frame arranged on the coupling, hence forming a first fulcrum, while its other end is hinged to the shroud, thereby creating a second fulcrum, and a third fulcrum is formed by hinging an actuator to the upper end of the shroud in the working or decoupling state. In this embodiment, it is particularly advantageous that the coupling head cover according to the invention is integrated in the coupling arrangement in an especially simple and easily realizable way. In a particularly advantageous manner, the three fulcrums are arranged in such a way as to enable simple assembly of the coupling head cover to the coupling on the one hand, and ensure an extensive pre-assembly of the module in the manufacturing process on the other. This embodiment is one way to enable the attachment of assemblies belonging to the coupling head cover exclusively to the coupling, so that no other mounts and attachment points are required on the vehicle. As a result, primarily the coupling head cover can be incorporated or replaced on the coupling arrangement very quickly and easily as an entire module.

In an advantageous further development of the above embodiment, the actuator is a piston/cylinder arrangement, whose free end is secured to the coupling. Such piston/cylinder arrangements are known for their maintenance-free application, and have already proven effective in similar applications, in particular in vehicle technology. It is particularly advantageous to secure the free end of the piston/cylinder arrangement to the coupling, since this actuator can thereby be integrated on the coupling arrangement in a particularly space-saving and easily realizable fashion.

In addition, it is also especially preferred that the piston/cylinder arrangement is mounted on the coupling by means of a cylinder receptacle. As a result, actuator integration can be tailored especially well to the respective application.

In a particularly preferred embodiment, the shroud has a roll on either side of fulcrum D, which are respectively rail-guided on a guiding rail when the shroud pivots. The combination of a roll with a guiding rail is a very easily realizable and still very effective device for guiding the linear motion that arises while pivoting the shroud. These components can hence be used to convert and realize the coupling head cover according to the invention in an especially simple and efficient manner. Of course, other embodiments are also conceivable here.

In a particularly preferred embodiment, the frame is pivoted to the coupling head, thereby forming a fulcrum A on both of its sides. This proves advantageous in particular when pivoting the coupling head cover, since the entire frame can be pivoted around fulcrum A when driving together the actuator.

In the latter embodiment, it is especially preferred to provide at least one tension spring between the coupling head and frame, which is tensioned by the force of the actuator when pivoting the shroud from the working or decoupling state into the resting or coupling state. A very simple motion to pivot the coupling head cover is hereby achieved in a particularly advantageous way. Proceeding from the closed coupling head cover, driving the actuator together pulls the coupling head cover along in its direction, wherein the coupling head cover is guided through the rolls in the guiding rails and forced to pivot around fulcrum C. At the end of the guiding rails, the rolls hit a stop. Again driving together the cylinder then pivots the entire frame around fulcrum A, simultaneously tensioning the tension springs.

It is particularly preferred to provide a seal between the front edge of the frame and the edge of the shroud. The seal provides reliable protection against weathering influences, in particular moisture, since the edge of the shroud with the provided seal abuts the edge of the frame lying opposite when the shroud is in the working or decoupling state.

It is particularly advantageous to provide an elastic skin between the frame and freight car paneling, since this ensures optimal protection for the vehicle components situated inside. In one advantageous further development of the method according to the invention, the frame is made to pivot back by the spring force of the tensioned tension spring if the actuator has released this backward pivoting motion. In the embodiment of the inventive solution where the actuator is realized as a piston/cylinder arrangement, all that must be done is to release the cylinder pressure to enable this backward pivoting by the frame. Of course, other procedural steps are also conceivable here.

BRIEF DESCRIPTION OF THE DRAWINGS

A preferred exemplary embodiment of the invention will be described in greater detail below based on the drawings.

DETAILED DESCRIPTION OF THE PREFERRED EMBODIMENT(S)

Figure 1:
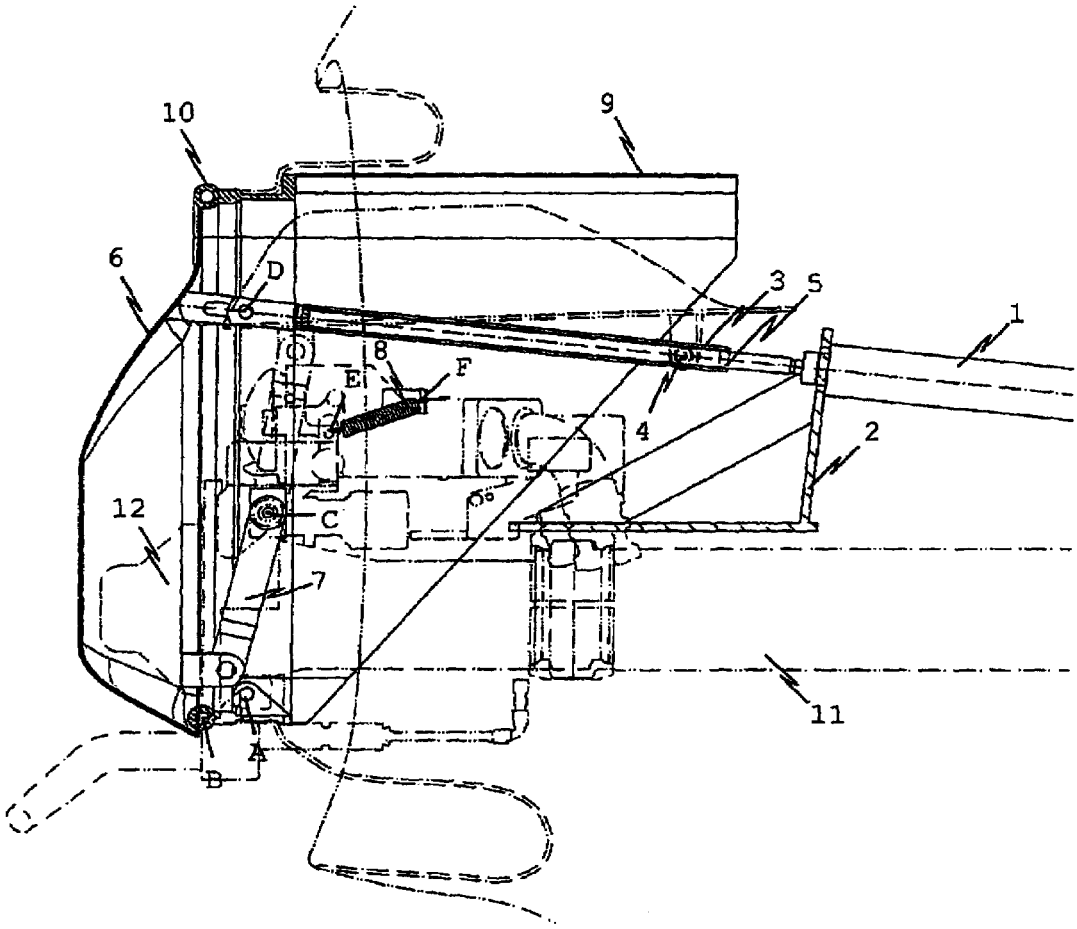
FIG. 1 illustrates a diagrammatic side view of the coupling head cover according to the invention in a preferred embodiment.

FIG. 1 shows a diagrammatic side view of the coupling cover according to the invention in a preferred embodiment. In this case, the cover is in the working state, in which the shroud 6 protects the coupling head 12, and particularly the moving assemblies situated therein, against environmental influences, such as dirt, snow, icing, etc. In this embodiment, the actuator is designed as a cylinder 1, which is rigidly mounted to the coupling 11 via the cylinder receptacle 2.

The piston rod of the cylinder is connected with the shroud 6 by means of a joint D. The shroud 6 can be pivoted around fulcrums B and C via a hinged arm 7, which resembles a lever, and is linearly guided through the rolls 4 in guiding rails 3. The shroud 6 is designed to pivot around fulcrums B and D with a hinge arrangement 7, B, C, D, wherein brackets 14, 15 are provided on the shroud, connected with D at the top and with B at the bottom.

The guiding rails 3, spring suspension point F and fulcrum C form a single unit with the frame 9. The frame 9 is pivoted at point A to the coupling head 12, and secured on the other side to the frame in spring suspension point F. To protect the interior vehicle components, an elastic skin 13 is provided between the frame 9 and vehicle paneling.

The coupling head cover shown on FIG. 1 is used in the working state to protect the coupling head 12, in particular the assemblies situated therein, against environmental influences such as dirt, snow, icing, etc., as well as against mechanical impact. The assemblies belonging to the coupling head cover are exclusively secured to the coupling 11. Therefore, no additional mounting and attachment points are provided on the vehicle. The self-contained construction of the coupling head cover enables simple assembly to the coupling 11. This makes it possible to very quickly and easily replace the entire module given damage to the coupling head cover.

Figure 2:
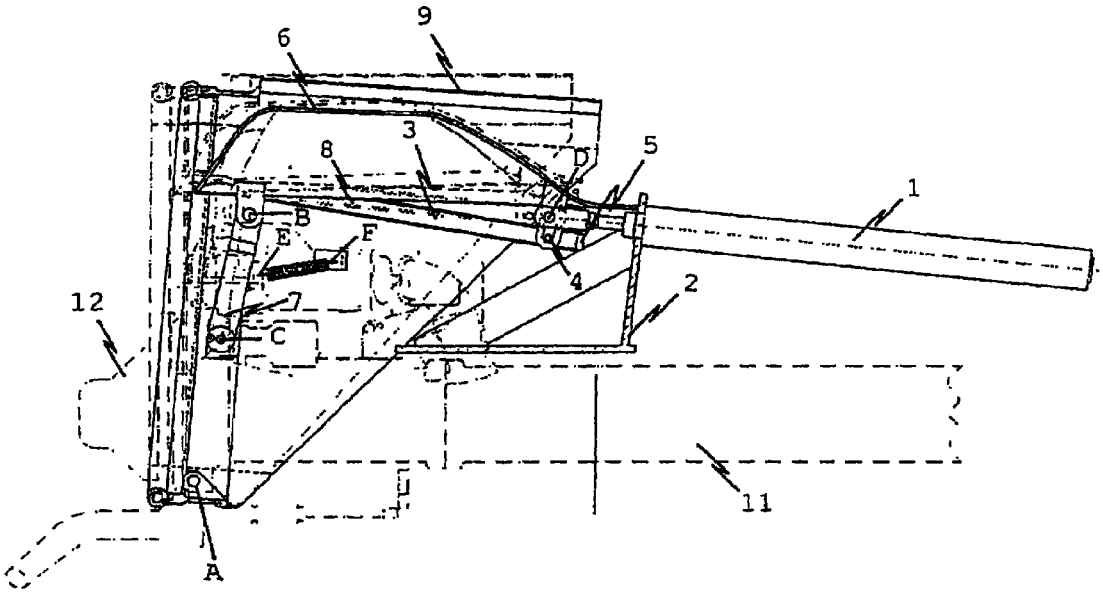
FIG. 2 illustrates a diagrammatic side view of the embodiment shown on FIG. 1 with the cover in a resting state.

FIG. 2 shows a diagrammatic side view of the coupling head cover according to the invention in the embodiment shown on FIG. 1, depicting the resting state of the cover. The cover is in a resting state when the coupling head 12 is coupled together with the coupling head 12 of an adjacent freight car. Proceeding from the closed shroud 6, it is pulled in the direction of the cylinder by driving together the cylinder. The shroud 6 is here guided into the guiding rails 3 through the rolls 4, and forced to pivot around the fulcrum C. The rolls 4 hit a stop 5 at the end of the guiding rails 3. Further driving together the cylinder now pivots the entire frame 9 around fulcrum A, simultaneously tensioning the tension springs 8.

The pivoting process is over when the cylinder has reached its setting. In this position, the frame 9 is used, among other things, to provide the shroud 6 with a sealing surface in the working state. To this end, a seal 10 is provided between the front edge of the frame 9 and the edge of the shroud 6. These edges come to rest opposite the edge of the frame 9 in the working or decoupling state of the shroud 6. The seal 10 ensures reliable protection against moisture penetrating into the coupling head 12.

REFERENCE LIST

1, 1' Actuator
2 Cylinder receptacle
3 Guiding rail
4 Roll
5 Stop
6 Shroud
7 Hinged arm
8 Tension spring
9 Frame
10 Seal
11 Coupling
12 Coupling head
13 Skin
14 Bracket
15 Bracket
A Fulcrum, frame-coupling head
B Fulcrum, lever-shroud
C Fulcrum, lever-frame
D Fulcrum; actuator-shroud
E Spring suspension point, coupling head
F Spring suspension point, frame

What is claimed is:

1. A coupling with a cover, comprising a coupling head and a shroud for protecting the coupling head, the shroud can be pivoted by means of a hinge arrangement from a working or decoupling state, in which the shroud is arranged in an essentially vertical position in front of the coupling head, into a resting or coupling state above the coupling, wherein said hinge arrangement comprises a first fulcrum formed at an upper end of the shroud in the working state, a second fulcrum, and an actuation means which is rigidly mounted to the coupling, and wherein, for swiveling the shroud, the first fulcrum is pulled towards the actuation means in a linear movement, while at the same time the shroud positively carries out a circular swivelling movement about the second fulcrum, with the opening of the shroud continually facing the coupling head, wherein the hinge arrangement is a triple-hinge with first, second, and third fulcrums and one hinged arm.

2. The coupling according to claim 1, wherein:

the hinge arrangement is connected with the shroud and with the coupling head or with a frame arranged on the coupling head.

3. The coupling according to claim 2 further comprising:

a seal between a front edge of the frame and an edge of the shroud, which in the working or decoupling state of the shroud comes into engagement opposite the front edge of the frame.

4. The coupling according to claim 2, further comprising:

an elastic cover between the frame and a car panel.

5. The coupling according to claim 1, wherein:

the hinged arm is hinged at one end to the coupling head or to a frame arranged on the coupling head thus forming the second fulcrum, and with its other end at the shroud, thus forming the third fulcrum, and wherein the first fulcrum is formed by hinging the actuation means at the upper end of the shroud in the working or decoupling state.

6. The coupling according to claim 5, wherein:

the actuation means includes a piston and cylinder arrangement which is be secured with its free end to the coupling.

7. The coupling according to claim 5, wherein:

the piston and cylinder arrangement is mounted on the coupling by means of a cylinder support.

8. The coupling according to claim 5, wherein:

the shroud in the first fulcrum includes a roller at either side, each of which is restrictedly guided in a guide rail upon the shroud being pivoted.

9. A coupling with a cover, comprising a coupling head and a shroud for protecting the coupling head mounted on and controlled by the coupling, the shroud can be pivoted by means of a hinge arrangement from a working or decoupling state, in which the shroud is arranged in an essentially vertical position in front of the coupling head, into a resting or coupling state above the coupling, wherein said hinge arrangement comprises a first fulcrum formed at an upper end of the shroud in the working state, a second fulcrum, and an actuation means which is rigidly mounted to the coupling, and wherein, for swiveling the shroud, the first fulcrum is pulled towards the actuation means in a linear movement, while at the same time the shroud positively carries out a circular swivelling movement about the second fulcrum, with the opening of the shroud continually facing the coupling head;

wherein the hinge arrangement is connected with the shroud and with the coupling head or with a frame arranged on the coupling head; and wherein a frame is pivotably connected with the coupling head, thus forming a fourth fulcrum on both of its sides.

10. The coupling according to claim 9, further comprising:

at least one tension spring between the coupling head and the frame, which is tensioned by the force of the actuation means upon the shroud being pivoted from the working or decoupling state into the resting or coupling state.

11. The coupling according to claim 9 further comprising:

a seal between a front edge of the frame and an edge of the shroud, which in the working or decoupling state of the shroud comes into engagement opposite the front edge of the frame.

12. The coupling according to claim 9, further comprising:

an elastic cover between the frame and a car panel.

* * * * *